US006857766B2

(12) United States Patent
Verdi

(10) Patent No.: US 6,857,766 B2
(45) Date of Patent: Feb. 22, 2005

(54) REVERSIBLE COVER AND DIFFUSER FOR A LAMPSHADE

(75) Inventor: Gina M. Verdi, Aston, PA (US)

(73) Assignee: Gina Verdi, Boothwyn, PA (US)

( * ) Notice: Subject to any disclaimer, the term of this patent is extended or adjusted under 35 U.S.C. 154(b) by 0 days.

(21) Appl. No.: 10/402,095

(22) Filed: Mar. 28, 2003

(65) Prior Publication Data

US 2004/0190296 A1 Sep. 30, 2004

(51) Int. Cl.[7] ..... F21V 1/06; F21V 1/16
(52) U.S. Cl. ..... 362/357; 362/360
(58) Field of Search ..... 362/351, 355, 362/357, 806, 358, 361, 360

(56) References Cited

U.S. PATENT DOCUMENTS

| | | | | |
|---|---|---|---|---|
| 4,731,715 A | | 3/1988 | Anderson | 362/352 |
| 5,341,933 A | | 8/1994 | Willows | 206/554 |
| 5,662,412 A | | 9/1997 | Glendmyer | 362/351 |
| 5,746,506 A | | 5/1998 | Dunbar | 362/351 |
| 6,302,566 B1 | | 10/2001 | Cohon | 362/351 |
| 2002/0071281 A1 | | 6/2002 | Dickson | 362/351 |
| 2002/0176256 A1 | * | 11/2002 | Gires | 362/351 |
| 2003/0016523 A1 | * | 1/2003 | Pickens | 362/35 |
| 2003/0200689 A1 | * | 10/2003 | Cohon | 40/673 |

* cited by examiner

*Primary Examiner*—Alan Cariaso
*Assistant Examiner*—Guiyoung Lee

(57) ABSTRACT

The present invention is a cover/diffuser for a lampshade. The cover/diffuser has a first pattern or theme printed on the first side and a second pattern or theme printed on the second side making the cover/diffuser reversible. The patterns are meant to complement the decor of the room in which the lamp is located or to assist in providing festive atmosphere for a specific holiday.

It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

13 Claims, 3 Drawing Sheets

REVERSIBLE COVER AND DIFFUSER FOR A LAMPSHADE

FIELD OF THE INVENTION

The present invention relates generally to home furnishing accessories and, more particularly, to a cover and/or diffuser for an existing lampshade.

BACKGROUND OF THE INVENTION

Most sources of electrical light, for example, incandescent bulbs and halogen bulbs and even the newer flourescent bulbs, produce a source of light that is usually too bright (or "harsh") to look at directly. Accordingly, lampshades are designed to cover the source of light to prevent the temporary blinding of a person looking directly at the light, to disperse as much light as possible, and/or to direct light in a particular direction (e.g., onto the floor) while simultaneously blocking light in another direction.

Lampshades are typically manufactured of relatively stiff material that is stretched around a rigid metal frame. The material is preferably opaque so that the source of light cannot be seen by others in the room in which the lamp is situated.

Most lamps manufactured today include some type of shade. It is common for the material which the lampshade is made to be a neutral color so that it coordinates with many decors. However, many "high-end" lampshades have a theme or pattern printed thereon in order to complement the lamp or other furnishings in the room.

Covers for lampshades are well known. However, there are a number of problems associated with placing a cover over a lampshade; for example, a common problem of covers for lampshades is that they create undesirable shadows as stated in U.S. Pat. No. 6,302,566 to Cohon.

SUMMARY OF THE INVENTION

The present invention relates to a reversible cover and diffuser for a lampshade that is relatively inexpensive to manufacture and easy to employ. The cover does not require any framing or other metallic support and can be draped over an existing lampshade.

The cover/diffuser has a first pattern or theme printed on the first side and a second pattern or theme printed on the second side making the cover/diffuser reversible. The patterns are meant to complement the decor of the room in which the lamp is located or to assist in providing festive atmosphere for a specific holiday.

The present cover is also designed to diffuse (and in one embodiment project a specific pattern) the remaining light that is generated by a lamp but which does not pass through the existing lampshade (especially the light that escapes from the top of the lampshade and immediately below the lampshade). The ability to diffuse the light from an existing lamp/lampshade is useful in order to set the mood in a room or to prevent the initial "blinding" effect when turning on the light in a completely dark room.

An aperture may be cut in the cover in order to produce a desirable pattern or other effect on the ceiling or wall. The pattern may be in keeping with a particular theme and preferably complements the decor of a room or other decorations in the room (e.g., in order to celebrate a particular holiday like Christmas, Easter, Yom Kippur, Halloween, etc.).

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which a cover/diffuser in accordance with the present invention is generally indicated at 10.

Figure 1:
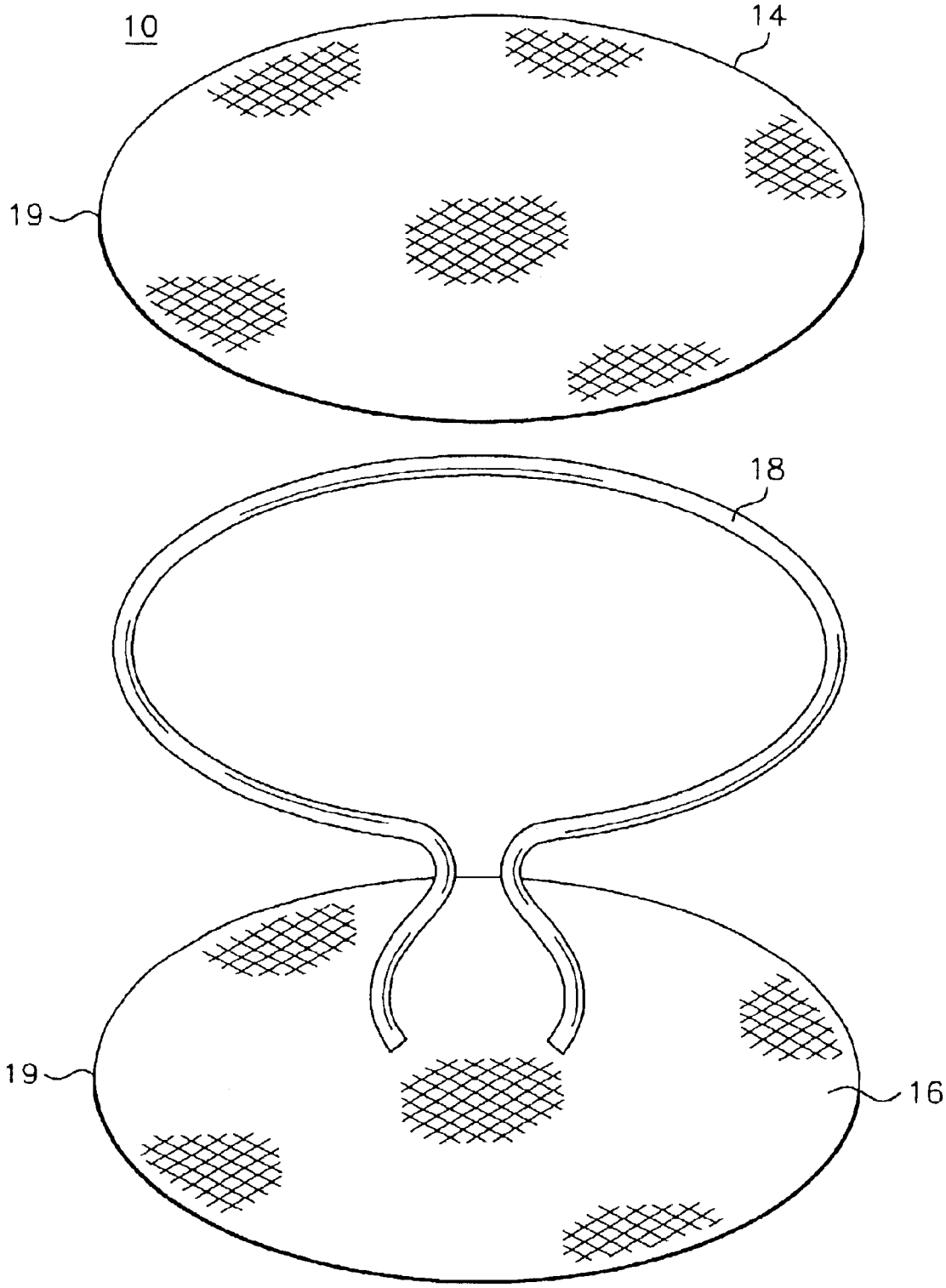
FIG. 1 is an exploded view of a cover/diffuser in accordance with the present invention.

FIG. 1 is an exploded view illustrating the major components of a cover/diffuser 10 in accordance with the present invention.

A bolt of fabric is cut into a circular shape to form a first side 14 of the lampshade cover 10. Another bolt of fabric, preferably having a different color or a different pattern printed thereon than the color or pattern of the first bolt of material, is also cut into a similarly-sized circular shape pattern to form a second side 16 of the cover 10.

An elongated cinch 18 is placed between the first side 14 and the second side 16 just inside the perimeters 19. The cinch 18 is designed to act as a drawstring in the fully-assembled diffuser 10.

Figure 2A:
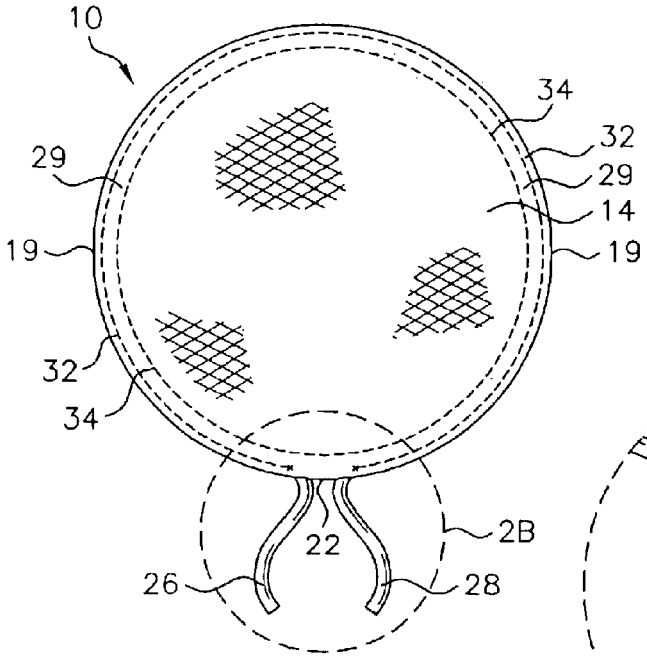
FIG. 2A is a top view of the cover/diffuser of FIG. 1 shown in its assembled state.

Referring now to FIG. 2A, a continuous or outer loop stitching 32 is sewn proximately around the perimeter 19 of the first and second sides 14, 16 while a second or inner continuous loop stitching 34 is sewn radially inside of the first stitching 32. The inner stitching 34 is spaced apart in a radial direction from the outer stitching 32 to define a channel 29 between first side 14 and second side 16. The cinch 18 is sandwiched between the first side 14 and the second side 16 but is free to move inside the channel 29.

Referring again to FIG. 2A, the channel 29 is formed just inside the perimeter 19 of the first 14 and second 16 sides. The outer loop stitching 32 and the inner loop stitching 34 form the perimeter channel 29. The stitching 32, 34 does not go through the cinch 18.

It is important to note that the outer stitching 32 does not form a complete circle. A small portion of the sides 14, 16 are not closed by outer stitching 32, thereby defining a relatively small aperture or opening 22 that communicates with and provides access to channel 29. A first end 26 of the cinch and a second end 28 of the cinch exit through the small opening 22. The cinch 18 is allowed to move freely within the channel 29 so that the cinch can act as a drawstring as will be illustrated later herein by pulling or adjusting ends 26, 28.

Figure 2B:
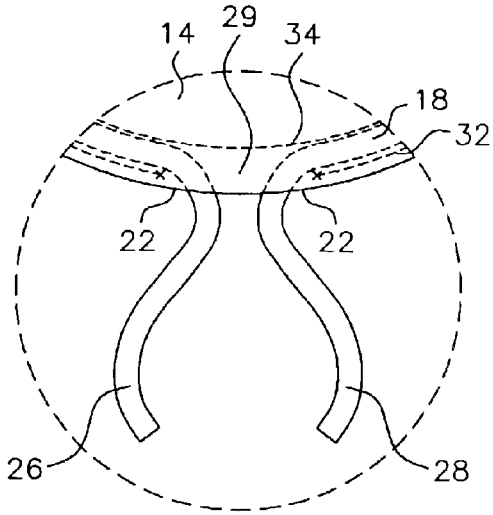
FIG. 2B is an enlarged view of a portion of FIG. 2A taken along circle 2B illustrating the cinch.

The small opening 22 and the ends of the cinch 26, 28 are illustrated in the enlarged view of FIG. 2B. A portion of the cinch 18 sandwiched between first side 14 and second side 16 is shown in dashed lines in FIG. 2B. The outer loop stitching 32 is terminated to form a small opening 22 to allow the ends 26, 28 of the cinch 18 to exit from the channel 29. It is important to note that the stitching 32, 34 simultaneously secures the first side 14 to the second side 16 and forms the channel 29.

A feature of the present invention is that the subject cover 10 is reversible. The small opening 22 is designed to communicate with the cinch 18 in order to draw it, thereby securing the cover/diffuser about a lampshade, regardless of which side (14 or 16) faces outward.

Figure 3:
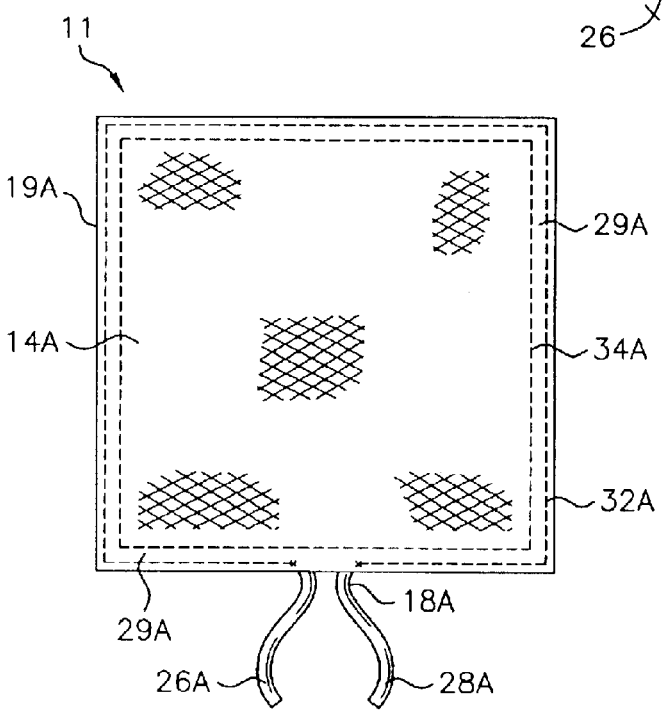
FIG. 3 is a top view of another embodiment of the present invention illustrating a square-shaped cover/diffuser.

Another embodiment of the present invention is illustrated in FIG. 3. In this embodiment, the cover/diffuser 11 is shaped as a square.

Instead of cutting circularly-shaped sides 14, 16, in the embodiment illustrated in FIG. 3, the first side 14A is cut in the shape of a square from a bolt of fabric; similarly, the second side is also cut in the shape of a square.

It will be apparent to one skilled in the art after a reading of the present application that the cover/diffuser may be made in various geometric shapes including square, pentagonal, hexagonal, octagonal, circular, etc. The shape of the sides does not materially alter the operation of the cover/diffuser. However, the shape of the perimeter of the cover/diffuser 10 may be seen below the lampshade in certain embodiments; this shape can add another aesthetic quality to the cover 10.

Continuing to refer to FIG. 3, inner loop stitching 34A and outer loop stitching 32A communicate to form a perimeter channel 29A. The channel 29A should be wide enough to allow cinch 18A to move freely within the channel. The ends 26A, 28A of the cinch exit the channel 29A at opening 22A which is positioned on one side of the square cover/diffuser 11. However, it may be more convenient to have the opening 22A proximate a corner of the square-shaped cover/diffuser 11.

Regardless of where opening 22A is positioned on the square-shaped cover 11, it will again cooperate with the cinch 18A to allow either side of the cover to face outwards when the cover is in use on a lampshade.

Figure 4A:
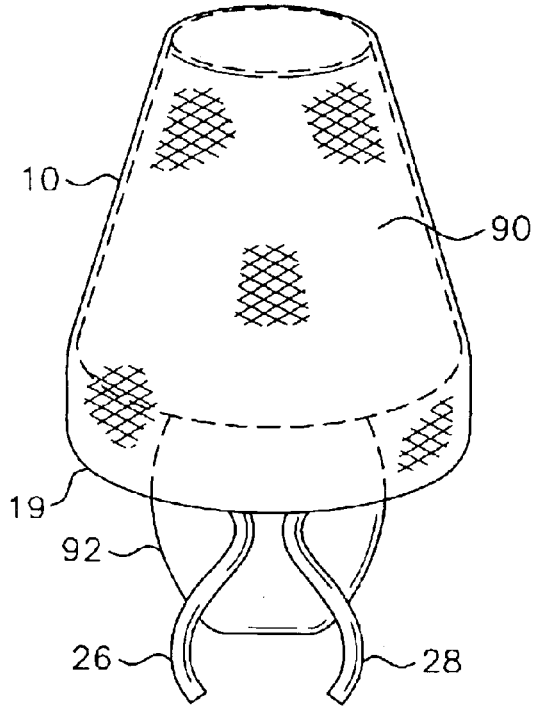
FIG. 4A is a perspective view of the cover/diffuser of FIG. 1 as applied to a typical lampshade with the cinch untied.

Referring now to FIG. 4A, a cover/diffuser 10 is draped over an existing lampshade 90 mounted on a lamp 92. It is not critical where the small opening 22 is positioned; however, it may be convenient to position the small opening 22 proximate the front of the lamp to allow access to the cinch ends 26, 28.

The cover/diffuser 10 does not have to be accurately sized for a particular lampshade, however, it is desired that the perimeter 19 of the cover/diffuser 10 hang a few inches below the bottom edge of the lampshade 90. This hangover portion helps to reduce the amount of light that shines from below the lampshade 90.

Figure 4B:
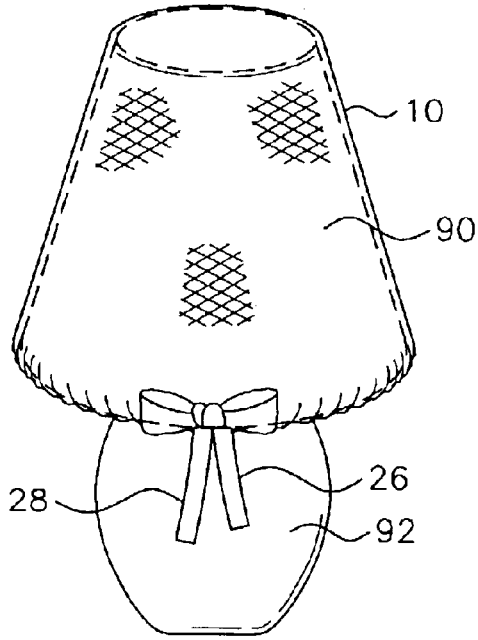
FIG. 4B is a perspective view of FIG. 4A with the cinch tied.

Referring now to FIG. 4B, the ends 26, 28 of the cinch are drawn and may be tied in a decorative bow or in any other manner desired in order to complement the decor of the room in which the lamp is placed. If the user does not wish to see the bow or other knot, the cover 10 may be applied so that the opening 22 is behind the lamp. By drawing and tying the cinch ends 26, 28, the cover 10 is removably secured to the lampshade 90.

Either first side 14 or second side 16 may be facing outwards for people to view. The outer stitching 32 that defines opening 22 allows the cover 10 to be reversible. As indicated previously, the first side 14 may be a solid color or bear a generic print, while the second side 16 may have a specific theme or holiday print. Therefore, most of the year, the first side 14 may be facing outwards. If the second side 16 had, for example, a bat or pumpkin print, the cover/diffuser 10 may be removed from the lampshade 90 by untying the bow, reversed and then re-draped over the lampshade, and secured by retying cinch ends 26, 28 so that the second side 16 is facing outwards for Halloween.

Figure 5:
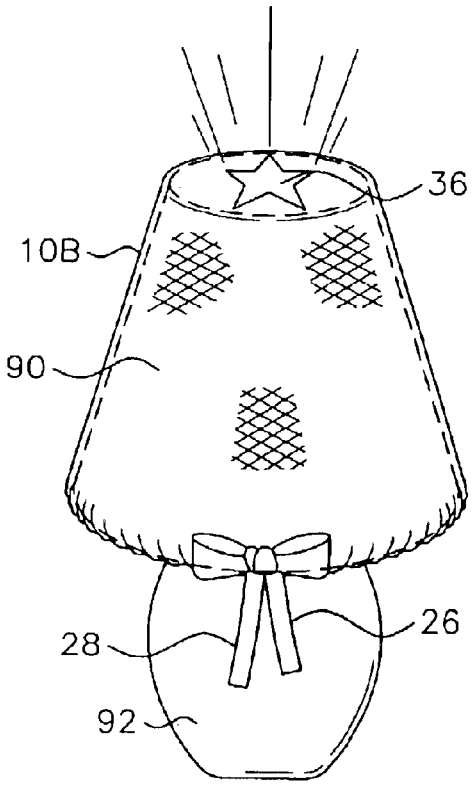
FIG. 5 is a perspective view of another embodiment of the present invention illustrating a cover/diffuser with a means of projecting a specific pattern on the ceiling.

FIG. 5 illustrates another embodiment of the present invention in which a design or shape is cut out of the cover/diffuser 10 which generally corresponds with the apex of the lampshade. A star-shaped cutout 36 is shown. (Unless the lampshade 90 is of an unusual shape, the apex should correspond generally to the center of the first side 14 and second side 16.) It may be desirable to stitch around the cutout 36 to ensure that first side 14 does not move relative to second side 16 thereby preventing the distortion of the true shape of the cutout.

The cut out allows a specific pattern of light to be reflected on the ceiling or other area of the room. It would be evident to one skilled in the art after reading the present application that different-shaped cutouts may be used. Moreover, depending on the brightness of the bulb, distance to the ceiling and other optical effects, the cutout 36 may have to be "fine-tuned" to obtain the desired shape on the ceiling.

Figure 6:
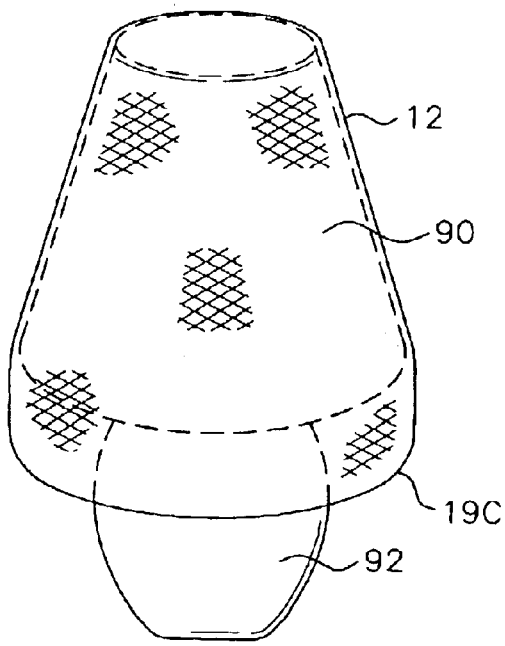
FIG. 6 is a perspective view of another embodiment of the present invention illustrating a cover/diffuser without a cinch.

Referring now to FIG. 6, another embodiment of the present invention, a cover/diffuser 12 without a cinch, is illustrated. In this embodiment, the first and second cover are stitched together around their perimeter without an opening 22 and without sandwiching a cinch between the sides 14, 16. In this embodiment, the cover/diffuser 12 is just draped over an existing lampshade. Again, the perimeter 19C of the cover/diffuser 12 extends below the bottom of the lampshade. Also, since there is no cinch, the weight of the cover/diffuser 12 keeps it positioned on the lampshade. In this embodiment, the perimeter of a different-shaped cover (e.g., octagonal) is more easily viewed since a cinch does not draw the perimeter snugly about the bottom of the lampshade.

In another embodiment, the cover/diffuser 12 shown in FIG. 6 may be provided with an elastically stretchable band sewn in the perimeter to allow the bottom of the cover 12 to snugly attach to the lampshade.

The cover/diffuser according to the present invention is used to partially block the light coming from an existing lamp. This is a useful feature when a lamp is turned on in the middle of the night such as when entering a room to attend to a crying baby, or to prevent a bright light from disturbing others (e.g., a sleeping spouse). Also, the cover/diffuser is meant to have aesthetic features that can be seen regardless of whether the lamp is off or on.

The present cover/diffuser 10 is versatile in that it is reversible, and may be designed with a particular pattern on one or both sides. For example, the second side 16 may have a Halloween, Easter, Christmas or Hanukkah design in keeping with a particular holiday. In this manner, the cover/diffuser can be used as a festive decoration for a specific holiday. The first side 14 is meant to have a different design than that printed on the second side 16 so that the cover/diffuser may be used for a second holiday or may remain plain to complement the existing furniture/decor in a room.

It would be apparent to one skilled in the art after reading the present application to make at least one side, but preferably both sides, of the cover/diffuser from a heat-resistant material depending, for example, on the type of lightbulb, distance of the lampshade from the lightbulb and shape of the lampshade to prevent the subject cover/diffuser from being scorched or damaged by the heat generated by the lightbulb. Also, heat treatments may be applied after the cover 10 is manufactured.

The cover/diffuser is designed to reduce the amount of light emanating from a lamp. The opaqueness of first side 14 and second side 16 may be specifically chosen before assembly of the cover/diffuser 10 to determine the reduction of the total amount of light that is given off by the lamp. If used in a baby's room, the user may choose to use a high opaqueness to reduce most of the light given off by the lamp; in contrast, if the cover/diffuser is to be used on a lamp in the living room, the user may choose a lower opaqueness. The cover/diffuser may be packaged so that the "opaqueness factor" is printed on the outside of the packaging.

It is important to note that the opaqueness of the first side 14 does not have to equal the opaqueness of the second side 16; this may result in a unique cover/diffuser that has different properties depending on which side faces outward.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. A lampshade cover for an existing lampshade attached to lamp, said cover comprising:

a pre-determined shape dimensional piece of flexible sheet material designed to be draped over the existing lampshade, wherein said predetermined shape dimensional piece is designed to extend approximately two to eight inches past the bottom of said lampshade, the material having an inner side that contacts the lampshade and an outer side, said inner side and outer side being reversible thereby making two different looks available to an observer.

2. The lampshade cover of claim 1 further comprising a method of treating the inner side to prevent scorching or burning of the material caused by the lamp.

3. The lampshade cover of claim 1 wherein the outer side is decorated in accordance with a particular theme.

4. The lampshade cover of claim 3 wherein said theme is to complement the decor of a room in which the lamp is located.

5. The lampshade cover of claim 3 wherein said theme is to celebrate a holiday.

6. The lampshade cover of claim 1 wherein said cover is designed to diffuse the light made by said lamp.

7. The lampshade cover of claim 1 wherein the cover has a pre-determined aperture in a specific shape in order to create a shape on the ceiling of the room above the apex of said lampshade cover in which the lamp is located.

8. The cover of claim 7 wherein said pre-determined aperture is in the shape of a star.

9. The cover of claim 1 wherein said pre-determined shape of flexible sheet material is circular.

10. The cover of claim 1 wherein said pre-determined shape of flexible sheet material is approximately square.

11. The lampshade cover of claim 1 wherein the sheet material is cloth fabric.

12. A lampshade cover for an existing lampshade attached to lamp, said cover comprising:

a pre-determined shape dimensional piece of flexible sheet material designed to be draped over the existing lampshade, the sheet material having an inner side that contacts the lampshade and an outer side, said inner side and outer side being reversible thereby making two different looks available to an observer; wherein the sheet material has a perimeter and is made of cloth fabric; and a channel formed around the perimeter of the sheet material and an elongated piece of material having a first end and a second end placed in said channel and an aperture that communicates with said channel and allows said first and second ends to exit therethrough so that the elongated piece can be drawn thereby closing the perimeter about the bottom of the lampshade when the ends are pulled.

13. A lampshade cover and diffuser for a lampshade, said cover and diffuser comprising:

a first piece of flexible material defining a first side of said cover;

a second piece of flexible material defining a second side of said cover;

a continuous outer loop stitching around the perimeter of said first and second pieces of material for securing said first and second pieces of material together;

a continuous inner loop stitching spaced apart radially inside of said outer loop stitching for securing said first and second pieces of material together and for defining a channel between said first and second pieces of material; and a cinch for sliding within said channel, the cinch having first and second ends, said ends extending through an opening in said outer loop stitching, said opening communicating with said channel so that said cover can be reversibly applied to the lampshade.

* * * * *